US008573126B2

(12) United States Patent
Klein et al.

(10) Patent No.: US 8,573,126 B2
(45) Date of Patent: Nov. 5, 2013

(54) CARTRIDGE BASE AND PLASTIC CARTRIDGE CASE ASSEMBLY FOR AMMUNITION CARTRIDGE

(75) Inventors: Thomas R. Klein, Utica, MI (US); Sy Wiley, Orlando, FL (US)

(73) Assignee: PCP Tactical, LLC, Vero Beach, FL (US)

( * ) Notice: Subject to any disclaimer, the term of this patent is extended or adjusted under 35 U.S.C. 154(b) by 158 days.

(21) Appl. No.: 12/847,319

(22) Filed: Jul. 30, 2010

(65) Prior Publication Data

US 2012/0024183 A1 Feb. 2, 2012

(51) Int. Cl.
*F42B 5/30* (2006.01)

(52) U.S. Cl.
USPC ..... 102/467; 102/430; 102/466

(58) Field of Classification Search
USPC ..... 102/464, 465, 467
See application file for complete search history.

(56) References Cited

U.S. PATENT DOCUMENTS

| | | | | | |
|---|---|---|---|---|---|
| 827,600 | A | * | 7/1906 | Bailey | 102/465 |
| 1,118,888 | A | * | 11/1914 | Butler | 102/465 |
| 1,233,071 | A | * | 7/1917 | Lindquist | 102/465 |
| 2,263,941 | A | * | 11/1941 | Albree | 102/464 |
| 2,294,822 | A | * | 9/1942 | Albree | 102/469 |
| 2,654,319 | A | | 10/1953 | Roske | |
| 2,862,446 | A | | 8/1955 | Ringdal | |
| 2,918,868 | A | | 12/1959 | Ringdal | |
| 2,995,090 | A | | 8/1961 | Daubenspeck | |
| 3,099,958 | A | * | 8/1963 | Daubenspeck et al. | 102/449 |
| 3,123,003 | A | | 3/1964 | Lange, Jr. et al. | |
| 3,144,827 | A | | 8/1964 | Boutwell et al. | |
| 3,485,170 | A | | 12/1969 | Scanlon | |
| 3,609,904 | A | | 10/1971 | Scanlon | |
| 3,659,528 | A | | 5/1972 | Santala | |
| 3,745,924 | A | | 7/1973 | Scanlon | |
| 3,785,293 | A | | 1/1974 | Barr | |
| 3,797,396 | A | | 3/1974 | Reed | |

(Continued)

FOREIGN PATENT DOCUMENTS

| | | |
|---|---|---|
| DE | 2205619 A1 | 8/1972 |
| DE | 3344369 A1 | 6/1985 |

(Continued)

OTHER PUBLICATIONS

Chung, Jerry S., "Alternative Cartridge Case Material and Design", Armament Research, Development and Engineering Center Technical Report ARAEW-TR-05007, May 2005.

(Continued)

*Primary Examiner* — Bret Hayes
*Assistant Examiner* — Joshua Freeman
(74) *Attorney, Agent, or Firm* — Troutman Sanders LLP

(57) ABSTRACT

A cartridge for ammunition has a base with an axial end section. An annular wall extends from the enlarged outer peripheral lip section to an opposite end. The axial end section has a primer cavity therein and a radially outwardly extending peripheral extraction lip. An annular ledge is axially positioned at an inner end of said primer cavity and radially extends inwardly from said annular wall. A passage has a reduced diameter compared to the primer cavity and extends through the annular ledge. A main charge cavity is at an opposite side of the ledge from the primer cavity. A knurl section is on an outer surface of said cylindrical wall. A cartridge case is attached to the base about said knurl section.

13 Claims, 2 Drawing Sheets

(56) References Cited

U.S. PATENT DOCUMENTS

| | | | | | |
|---|---|---|---|---|---|
| 3,808,974 | A | * | 5/1974 | Herter | 102/466 |
| 3,842,739 | A | | 10/1974 | Scanlon et al. | |
| 3,874,294 | A | * | 4/1975 | Hale | 102/467 |
| 3,935,816 | A | | 2/1976 | Boquette, Jr. | |
| 3,955,506 | A | * | 5/1976 | Luther et al. | 102/467 |
| 3,977,326 | A | | 8/1976 | Anderson et al. | |
| 3,999,482 | A | * | 12/1976 | Bilek | 102/363 |
| 4,147,107 | A | * | 4/1979 | Ringdal | 102/467 |
| 4,165,943 | A | * | 8/1979 | Beach et al. | 403/285 |
| 4,173,186 | A | * | 11/1979 | Dunham | 102/430 |
| 4,187,271 | A | | 2/1980 | Rolston et al. | |
| 4,469,027 | A | * | 9/1984 | Burns et al. | 102/521 |
| 4,498,396 | A | | 2/1985 | Berube | |
| 4,546,704 | A | | 10/1985 | Ballreich et al. | |
| 4,620,485 | A | | 11/1986 | Bertiller | |
| 4,683,170 | A | | 7/1987 | Tse et al. | |
| 4,719,859 | A | | 1/1988 | Ballreich et al. | |
| 4,726,296 | A | | 2/1988 | Leshner et al. | |
| 4,738,202 | A | * | 4/1988 | Hebert | 102/467 |
| 4,803,926 | A | | 2/1989 | Barton et al. | |
| 4,809,612 | A | | 3/1989 | Ballreich et al. | |
| 5,033,386 | A | | 7/1991 | Vatsvog | |
| 5,063,853 | A | | 11/1991 | Bilgeri | |
| 5,151,555 | A | | 9/1992 | Vatsvog | |
| 5,165,040 | A | * | 11/1992 | Andersson et al. | 102/464 |
| 5,233,928 | A | | 8/1993 | Ducros et al. | |
| 5,237,930 | A | | 8/1993 | Belanger et al. | |
| 5,259,288 | A | | 11/1993 | Vatsvog | |
| 5,563,365 | A | | 10/1996 | Dineen et al. | |
| 5,616,642 | A | | 4/1997 | West et al. | |
| 5,653,563 | A | * | 8/1997 | Ernst et al. | 411/82 |
| 5,708,231 | A | | 1/1998 | Koon | |
| 5,770,815 | A | | 6/1998 | Watson | |
| 5,893,959 | A | | 4/1999 | Muellich | |
| 5,969,288 | A | | 10/1999 | Baud | |
| 6,048,379 | A | | 4/2000 | Bray et al. | |
| 6,074,454 | A | | 6/2000 | Abrams et al. | |
| 6,101,949 | A | | 8/2000 | Maucourt et al. | |
| 6,131,519 | A | | 10/2000 | Thiesen et al. | |
| 6,257,149 | B1 | | 7/2001 | Cesaroni | |
| 6,283,035 | B1 | | 9/2001 | Olson et al. | |
| 6,439,123 | B1 | | 8/2002 | Dionne et al. | |
| 6,523,476 | B1 | * | 2/2003 | Riess et al. | 102/431 |
| 6,539,874 | B2 | | 4/2003 | Weise | |
| 6,598,536 | B2 | | 7/2003 | Burri | |
| 6,752,084 | B1 | | 6/2004 | Husseini et al. | |
| 6,845,716 | B2 | | 1/2005 | Husseini et al. | |
| 6,886,467 | B1 | | 5/2005 | Haeselich | |
| 7,032,492 | B2 | | 4/2006 | Meshirer | |
| 7,059,234 | B2 | | 6/2006 | Husseini | |
| 7,165,496 | B2 | | 1/2007 | Reynolds | |
| 7,204,191 | B2 | | 4/2007 | Wiley et al. | |
| 7,213,519 | B2 | | 5/2007 | Wiley et al. | |
| 7,441,504 | B2 | * | 10/2008 | Husseini et al. | 102/466 |
| 7,610,858 | B2 | * | 11/2009 | Chung | 102/466 |
| 8,087,359 | B2 | * | 1/2012 | Sauvestre | 102/439 |
| 8,240,252 | B2 | | 8/2012 | Maljkovic et al. | |
| 2003/0019385 | A1 | | 1/2003 | Leasure et al. | |
| 2005/0188879 | A1 | | 9/2005 | Wiley et al. | |
| 2005/0188883 | A1 | | 9/2005 | Husseini et al. | |
| 2005/0257711 | A1 | | 11/2005 | Husseini et al. | |
| 2006/0011087 | A1 | | 1/2006 | Husseini et al. | |
| 2006/0207464 | A1 | * | 9/2006 | Maljkovic et al. | 102/466 |
| 2007/0214992 | A1 | | 9/2007 | Dittrich | |
| 2007/0261587 | A1 | * | 11/2007 | Chung | 102/469 |
| 2009/0044717 | A1 | | 2/2009 | Husseini et al. | |
| 2010/0056687 | A1 | | 3/2010 | Diakoumakos et al. | |
| 2010/0275804 | A1 | | 11/2010 | Trivette | |
| 2010/0282112 | A1 | * | 11/2010 | Battaglia | 102/467 |
| 2010/0305261 | A1 | | 12/2010 | Maljkovic et al. | |
| 2011/0179965 | A1 | | 7/2011 | Mason | |
| 2012/0060716 | A1 | | 3/2012 | Davies et al. | |
| 2012/0111219 | A1 | | 5/2012 | Burrow | |
| 2012/0180687 | A1 | | 7/2012 | Padgett | |
| 2012/0180688 | A1 | | 7/2012 | Padgett | |

FOREIGN PATENT DOCUMENTS

| | | | |
|---|---|---|---|
| EP | 0096617 | | 12/1983 |
| EP | 0444545 | A1 | 9/1991 |
| EP | 0526317 | A1 | 2/1993 |
| FR | 1081764 | A | 12/1954 |
| GB | 2092274 | | 8/1982 |
| WO | WO 88/09476 | A1 | 12/1988 |
| WO | WO 9513516 | A1 | 5/1995 |
| WO | WO 2006094987 | | 9/2006 |
| WO | WO 2010129781 | | 11/2010 |
| WO | WO 2012/047615 | A1 | 4/2012 |
| WO | WO 2012097317 | A2 | 7/2012 |
| WO | WO 2012097317 | A3 | 7/2012 |
| WO | WO 2012097320 | A1 | 7/2012 |

OTHER PUBLICATIONS

File history of U.S. Appl. No. 61/456,664, which corresponds to US 2012/0111219.

* cited by examiner

CARTRIDGE BASE AND PLASTIC CARTRIDGE CASE ASSEMBLY FOR AMMUNITION CARTRIDGE

TECHNICAL FIELD

The field of this invention relates to an improved connection between a metal cartridge base and plastic cartridge case for an ammunition cartridge.

BACKGROUND OF THE DISCLOSURE

Ammunition cartridges have been made from composite components, commonly a plastic case and a metallic base assembled together. The base and case must have sufficient integrity to withstand the explosive force of the igniting powder in the case when the bullet is fired out of the cartridge and its subsequent extraction from the firing chamber.

The single use nature of ammunition cartridges dictates the desire to have a structurally sound cartridge that is expeditiously made at a low cost.

SUMMARY OF THE DISCLOSURE

In accordance with one aspect of the invention, a cartridge for ammunition includes a base having an axial end section with a primer cavity therein and a radially outwardly extending peripheral extraction lip. An annular wall extends from the enlarged outer peripheral lip section to an opposite end. An annular ledge radially extends inwardly from the annular wall at an inner end of the primer cavity. A passage has a reduced diameter compared to the central cavity and extends through the annular ledge. A main charge cavity is positioned at an opposite side of the ledge from the primer cavity within the confines of the annular wall. The annular wall has a knurl section on its outer face. The knurl section has canted grooves. A cartridge case is attached to the base about the knurl section.

Preferably, the knurl section is axially aligned in part with the ledge and fully circumscribes the outer surface of the annular wall. In one embodiment, the base is made from carbon steel. In one embodiment, the knurl section has cross-hatched canted grooves thereon to form diamond shaped hatchings.

In accordance with another aspect of the invention, a cartridge for ammunition has a base with an interior main cavity section for storing a charge. The base has an annular wall with an outer facing surface. The outer facing surface has an annular knurl section having cross-hatched grooves forming diamond shaped hatchings. The cartridge case is connected about the annular wall and to the knurl section.

Preferably, the cross-hatched grooves are canted with respect to the axial axis of the cartridge. In one embodiment, the knurl section is axially aligned in part with a thickened section of the annular wall. The base preferably has an enlarged diameter extraction lip at an axial end section. The base is preferably made from carbon steel.

In accordance with another aspect of the invention, a cartridge for ammunition has a base with an annular wall and an interior cavity for storing a charge extending from an open front end to a ledge radially extending inwardly from the annular wall and axially positioned between the open front end and a rear end. The annular wall extends to the open front end circumscribing the interior cavity. The annular wall section has a knurl section axially aligned in part with the ledge. A plastic cartridge case has a rear end with an outer flange for extending about the annular wall and engaging the knurl section and an inner flange extending about the cavity inside the annular wall such that the annular wall is sandwiched between the inner and outer flanges with the knurl section engaging the outer flange.

In one embodiment, the knurl section is formed by angled grooves angled with respect to a longitudinal axis of the cartridge. The grooves form diamond shaped hatchings. In one embodiment, the knurl section is formed from cross-hatched grooves to form diamond shaped hatchings. Preferably, the base is made from carbon steel.

In accordance with another aspect of the invention, a base for an ammunition cartridge has an axial end section with a primer cavity therein and a radially outwardly extending peripheral extraction lip. An annular wall extends from the enlarged outer peripheral lip section to an opposite end. An annular ledge radially extends inwardly at an inner end of the primer cavity from the annular wall. A passage has a reduced diameter compared to the primer cavity and extends through the annular ledge. A main charge cavity is positioned at an opposite side of the ledge from the primer cavity. The annular wall has a knurl section on its outer surface. The knurl section has angular canted grooves. A cartridge case is attached to the base about the knurl section.

Preferably, the knurl section is axially aligned in part with the ledge and fully circumscribes the outer surface of the annular wall. In one embodiment, the base is made from carbon steel. In one embodiment, the knurl section has cross-hatched angular grooves thereon to form diamond shaped hatchings.

In accordance with another aspect of the invention, a method of manufacturing a composite ammunition cartridge includes pressure forming a metallic base with an axial end section having a primer cavity therein and a radially outwardly extending extraction lip. An annular wall portion is pressure formed to extend from the enlarged outer peripheral lip section to an opposite end. An annular ledge is pressure formed to radially extend inwardly from the annular wall and is axially positioned at an inner end of the primer cavity. A passage that has a reduced diameter compared to the primer cavity extends through the annular ledge. A main charge cavity is pressure formed at an opposite side of the wall section from the primer cavity within the confines of the annular wall. A knurl section is pressure formed on an outer surface of the annular wall. The knurl section has canted grooves thereon. A cartridge case is molded about the periphery of the outer facing cylindrical wall and intrudes into the knurl section.

Preferably, the pressure forming is a high speed cold forming. Preferably, carbon steel material is cold formed in shape to form the base.

In one embodiment, the cartridge case has an outer flange molded about the periphery of the annular wall and intrudes into the knurl section. The cartridge case also has an inner flange molded within the confines of the annular wall portion.

BRIEF DESCRIPTION OF THE DRAWINGS

Reference now is made to the accompanying drawings in which.

DETAILED DESCRIPTION OF THE PREFERRED EMBODIMENT

Figure 1:
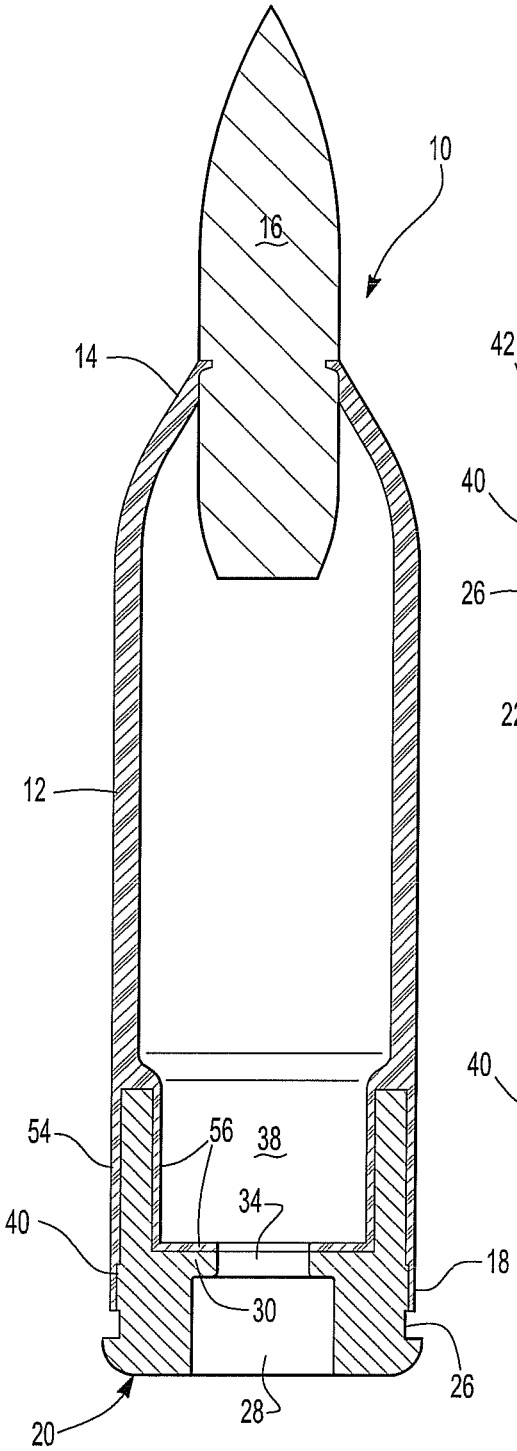
FIG. 1 is a side elevational sectional view of a bullet and cartridge in accordance with one embodiment of the invention.

Referring now to FIG. 1, a cartridge 10 for ammunition has a cartridge case 12 with a front end 14 releasably connected in a conventional fashion to a bullet or other weapon projectile 16. The cartridge case can be made from a plastic material, for example a suitable polymer. The rear end 18 of the cartridge case is connected to a base 20.

Figure 2:
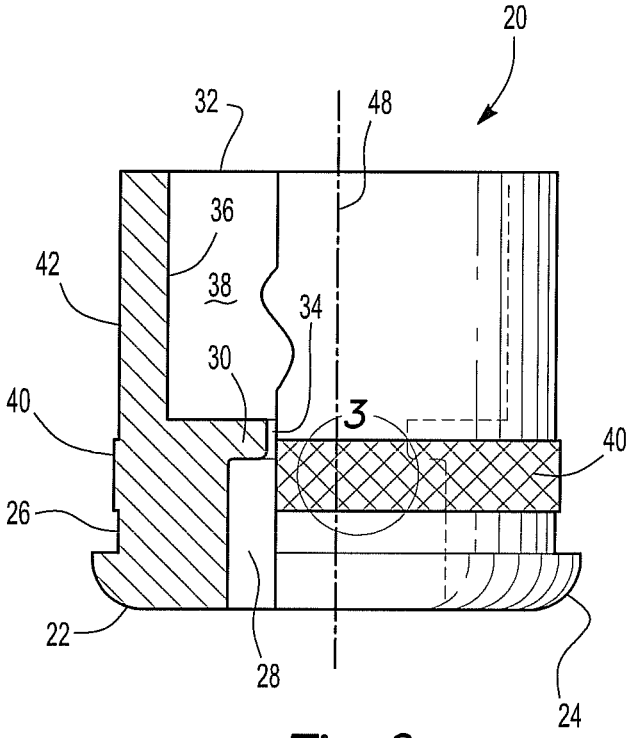
FIG. 2 is an enlarged partially sectioned view of the base shown in FIG. 1 further illustrating the cross hatching on the outer surface of the annular wall.

The base 20 as shown in FIG. 2 has a rear end 22 with an enlarged extraction lip 24 and groove 26 just in front to allow extraction of the base in a conventional fashion. An annular cylindrical wall 36 extends forward from the rear end 22 to the front end 32. A primer cavity 28 is located at the rear end 22 and extends to a radially inwardly extending ledge 30 axially positioned intermediate the rear end 22 and front end 32. A reduced diameter passage 34 passes through the ledge 30. The cylindrical wall 36 defines an open ended main cavity 38 from the ledge 30 to open end 32.

The primer cavity 28 and reduced passage 34 are dimensioned to provide enough structural steel at annular wall 36 and ledge 30 to withstand any explosive pressures outside of the gun barrel. As shown in the drawings, these thicknesses are greater than the wall thickness of the cylindrical wall 36 about the main cavity 38.

The outer surface 42 of the cylindrical wall 36 has a raised knurl section 40. The knurl section 40 is annular, i.e. it extends completely about the outer surface 42 of the annular cylindrical wall 36. The axial position of the knurl is partially aligned with the axial position of the radially inwardly ledge 30.

Figure 3:
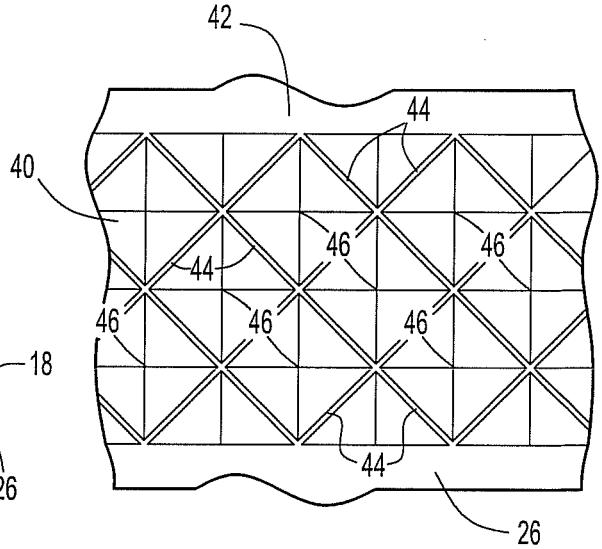
FIG. 3 is a highly enlarged view illustrating the diamond shape of the cross hatching shown in FIG. 2.

As clearly shown in FIGS. 2 and 3, the knurl section 40 has left right diagonal line knurls 44 which are also referred to as grooves that are cross hatched to form diamond shaped peaks 46. The left and right line knurls 44 are angled with respect to the longitudinal axis 48 of the cartridge.

Figure 4:
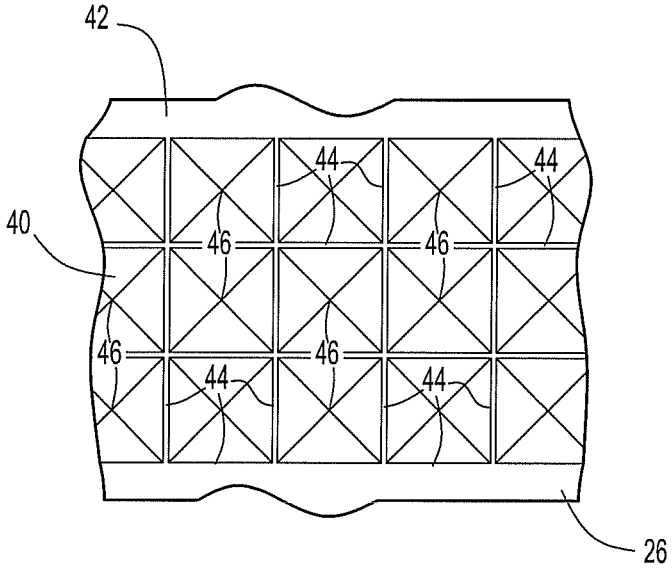
FIG. 4 is a view similar to FIG. 3 illustrating an alternate embodiment of the diamond hatching.

In another embodiment shown in FIG. 4, the line knurls 44 are not angled but run either parallel to the axis 48 or transverse with the axis 48 to form the diamond shaped peaks 46.

Figure 5:
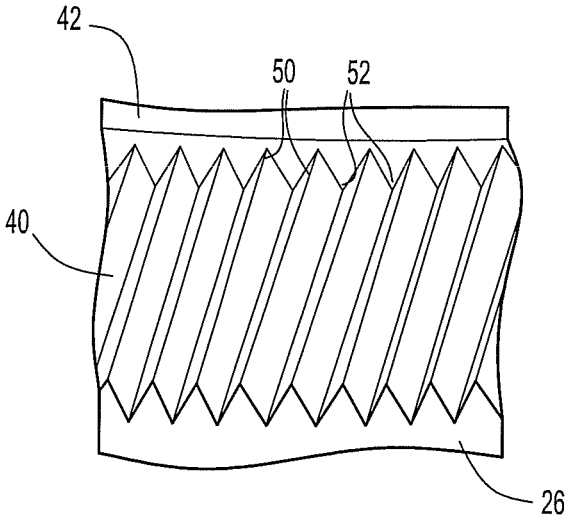
FIG. 5 is a view similar to FIG. 3 illustrating another alternate embodiment of the knurl section at the outer surface of the annular wall.

In another embodiment shown in FIG. 5, there are only angled line knurls 52 that are parallel to each other to form longitudinal and angled ribs 50.

While the dimensions may vary due to different caliber ammunition, one knurl length can range from 0.050 to 0.160 inches extending from above the extractor lip 24 toward the front end 32. The knurl 40 forms a raised pattern which is 0.004 to 0.010 inches above the nominal diameter of the outer surface 42 of the wall 36.

The base can be made by pressure forming carbon steel material. Preferably the carbon steel is cold formed into shape. The carbon steel may for example be 1010 type ranging to 1035 type steel. The knurl section 40 is formed during the heading operation of the formed steel insert. No corrosion coating is needed. The base after being cold formed may be heat treated.

After the base 20 is cold formed and optionally heat treated, the plastic cartridge case is molded about the base 20 with an outer flange 54 molded over the outer surface 42 and adhering and positively interlocking with the knurl section 40. An inner flange 56 can be molded within the cylindrical wall 34 and overlie the radially inward extending ledge 30 such that wall 36 becomes sandwiched between the two flanges 54, 56.

Alternatively, the outer flange 54 may be ultrasonically connected to the base. When ultrasonic welding is used, the angled groove hatching shown in FIG. 5 is preferred.

In this fashion, by cold forming of the carbon steel insert into shape to form a base 20, expensive machining process of a groove into stainless steel is eliminated and significant reduction in manufacturing costs is possible by eliminating the need for prohibitively expensive amount of equipment and investment required for the manufacturing of high volumes of machined grooved bases.

The knurl replaces the machined retaining groove which previously was required to mechanically bond the polymer to the steel insert. The retaining groove previously needed to retain the cartridge case to the base cannot be formed in a cold heading operation with today's technology.

Furthermore, the integrity of the cartridge 10 particularly at the junction at the base 20 and polymer cartridge 12 at flanges 54 and 56 is improved and a free gas path between the molded polymer and steel is prevented upon expansion of the polymer material during firing of the cartridge. By eliminating the free gas path, a rapid burn through is also eliminated which otherwise can result in immediate cartridge failure and a jammed weapon.

Due to different expansion rates of the relatively softer polymer material of the cartridge case 12 compared to the steel material of the base 20, the knurl form embedded into the polymer allows the polymer to expand without opening a free gas path. Furthermore, as expansion of the knurl subsequently occurs, the knurl is forced deeper into the overmolded polymer which cannot expand further beyond the clearance allowed by the breech of the weapon. Thus, the mechanical bond between the overmolded formed base with the cartridge case 12 is maintained from its pre-fired dimensions to its after fired dimensions in the weapon.

Other variations and modifications are possible without departing from the scope and spirit of the present invention as defined by the appended claims.

The embodiments in which an exclusive property or privilege is claimed are defined as follows:

1. A cartridge for ammunition comprising:

a base having an axial end section having a primer cavity therein and a radially outwardly extending peripheral extraction lip;

an annular wall extending from said enlarged outer peripheral lip section to an opposite end;

an annular ledge axially positioned at an inner end of said primer cavity and radially extending inwardly from said annular wall;

a passage having a reduced diameter compared to said primer cavity and extending through said annular ledge;

a main charge cavity at an opposite side of said ledge from said primer cavity and within the confines of the annular wall;

a knurl section on an outer surface of said annular wall;

said knurl section having canted grooves thereon; and a plastic cartridge case having a rear end comprising:

an outer flange extending about said annular wall and engaging said knurl section, and an inner flange extending about said main charge cavity inside said annular wall and overlay an entirety of said annular ledge only to said passage, wherein said annular wall is sandwiched between said inner and outer flanges with said knurl section engaging said outer flange, and wherein said knurled section forms a raised pattern extending outward from said outer surface of said annular wall from 0.004 to 0.010 inches.

2. The cartridge as defined in claim 1 wherein said knurl section axially aligns in part with said annular ledge and fully circumscribes said outer surface of said annular wall.

3. The cartridge as defined in claim 1 wherein said base being made from carbon steel.

4. The cartridge as defined in claim 1 wherein said canted grooves are cross-hatched and form diamond shaped hatchings.

5. The cartridge as defined in claim 1 wherein said knurl section axially aligns in part with a thickened section of said annular wall.

6. The cartridge as defined in claim 1 wherein said knurl section is formed by grooves angled with respect to a longitudinal axis of said cartridge.

7. A method of manufacturing a composite ammunition cartridge comprising:

pressure forming a metallic base with an axial end section having a primer cavity therein and a radially outwardly extending extraction lip;

extending a pressure formed annular wall from said enlarged outer peripheral lip section to an opposite end;

axially positioning an annular ledge pressure formed at an inner end of said primer cavity and radially extending said annular ledge inwardly from said annular wall;

forming a passage with a reduced diameter compared to said primer cavity and extending through said annular ledge;

pressure forming a main charge cavity opposite of said annular ledge from said primer cavity;

knurling a knurl section on an outer surface of said annular wall having grooves pressure formed thereon and extending outward from said outer surface of said annular wall from 0.004 to 0.010 inches; and molding an outer flange of a cartridge about the periphery of an outer surface of the annular wall and intruding into said knurl section, and molding an inner flange of said cartridge to extend about said main charge cavity inside said annular wall and overlay an entirety of said annular ledge only to said passage, wherein said annular wall is sandwiched between said inner and outer flanges.

8. The method as defined in claim 7 further comprising: said pressure forming being high speed cold forming.

9. The method as defined in claim 7 further comprising: said metallic base being made from carbon steel.

10. The cartridge as defined in claim 1 wherein said knurl section extends from 0.050 to 0.160 inches above said extraction lip.

11. The cartridge as defined in claim 1 wherein said annular wall comprises a uniform diameter outer surface.

12. The method as defined in claim 7 wherein said knurling step includes extending said knurl section from 0.050 to 0.160 inches above said extraction lip.

13. The method as defined in claim 7 wherein said annular wall comprises a uniform diameter outer surface.

* * * * *